US008132434B2

(12) United States Patent
Buis

(10) Patent No.: US 8,132,434 B2
(45) Date of Patent: Mar. 13, 2012

(54) CLOSURE MEANS FOR HOLDING CLOSED A DOOR

(75) Inventor: Dirk Buis, Ijmuiden (NL)

(73) Assignee: Trend Top International HK Ltd, Hong Kong (HK)

( * ) Notice: Subject to any disclaimer, the term of this patent is extended or adjusted under 35 U.S.C. 154(b) by 807 days.

(21) Appl. No.: 11/955,907

(22) Filed: Dec. 13, 2007

(65) Prior Publication Data

US 2008/0155781 A1 Jul. 3, 2008

(30) Foreign Application Priority Data

Dec. 27, 2006 (NL) ..... 2000408
Feb. 13, 2007 (NL) ..... 1033383
Jun. 19, 2007 (NL) ..... 2000716

(51) Int. Cl.
*E05B 65/12* (2006.01)

(52) U.S. Cl. ..... 70/14; 70/19; 70/69; 70/240; 24/132 R; 24/132 L; 292/258; 292/288; 292/DIG. 69

(58) Field of Classification Search ..... 70/14, 49, 70/240, 18, 30, 58, 233, 241, 19, 69, 76; 292/288, DIG. 69, 258; 24/132 R, 133, 134 L, 24/134 P, 134 R, 134 KB
See application file for complete search history.

(56) References Cited

U.S. PATENT DOCUMENTS 4,639,978 A * 2/1987 Boden ..... 24/134 R
4,685,315 A * 8/1987 Comolli ..... 70/68
5,096,241 A * 3/1992 Badger ..... 292/288
5,144,821 A * 9/1992 Ernesti et al. ..... 70/159
5,209,533 A * 5/1993 Menard ..... 292/288
5,320,398 A * 6/1994 Popp et al. ..... 296/76
5,369,970 A 12/1994 Voiculescu et al. ..... 70/240
5,582,046 A 12/1996 Baumwoll et al. ..... 70/237
5,692,403 A * 12/1997 Ling ..... 70/312
5,786,759 A * 7/1998 Ling ..... 340/542
5,794,871 A * 8/1998 Willetts ..... 292/288
5,842,359 A * 12/1998 Longueira ..... 70/14
6,044,669 A * 4/2000 Levi ..... 70/18
6,199,412 B1 * 3/2001 Kennedy ..... 70/18
6,212,919 B1 * 4/2001 Gerow ..... 70/18
6,665,913 B2 * 12/2003 Kosh et al. ..... 24/193
6,883,354 B1 * 4/2005 Yu ..... 70/18
6,931,894 B2 * 8/2005 Yu ..... 70/18
7,032,415 B2 * 4/2006 Young ..... 70/18
(Continued)

*Primary Examiner* — Lloyd Gall
(74) *Attorney, Agent, or Firm* — St. Onge Steward Johnston & Reens LLC

(57) ABSTRACT

A closure for holding closed a door which is able to hinge in a frame, having a securing device which can be positioned on a first edge of the closed door and also a tightening unit which can be positioned on a second edge of the closed door and a cable or strap which, when the door is closed, runs through a gap between the door and frame and is fastened at one end to the securing device and fastened at the other end in the tightening unit, the tightening unit having inter alia a base plate with an opening for feeding through the cable or strap and also a tightening mechanism for tensioning and holding under tension the cable or strap guided through the opening and a cap with a lock which can be positioned on the base plate so as to produce a seal around the tightening mechanism. The securing device has a support extending on both sides of the cable or strap over a distance which is greater than the gap between the closed door and the frame, which distance is preferably greater than 5 mm.

20 Claims, 3 Drawing Sheets

U.S. PATENT DOCUMENTS 7,121,122 B2 * 10/2006 Levi ..... 70/18
7,175,149 B2 * 2/2007 Gallien ..... 248/500
7,293,438 B2 * 11/2007 Benda ..... 70/18
7,434,425 B2 * 10/2008 Mahre et al. ..... 70/18
7,454,932 B2 * 11/2008 Hollier ..... 70/18

* cited by examiner

CLOSURE MEANS FOR HOLDING CLOSED A DOOR

CROSS-REFERENCE TO RELATED APPLICATIONS

The present application claims priority from The Netherlands patent application no. 2000408, filed Dec. 27, 2006, The Netherlands patent application no. 1033383, filed Feb. 13, 2007 and The Netherlands patent application no. 2000716, filed Jun. 19, 2007, the content of which is incorporated herein by reference.

FIELD OF THE INVENTION

The invention relates to a closure means for holding closed a door. The invention further relates to closure means for holding closed a door which is able to hinge in a frame, comprising a securing means which can be positioned on a first edge of the closed door and also a tightening unit which can be positioned on a second edge of the closed door and a cable or strap which, when the door is closed, runs through a gap between the door and frame and is fastened at one end to the securing means and fastened at the other end in the tightening unit, the tightening unit comprising inter alia a base plate with an opening for feeding through the cable or strap and also a tightening mechanism for tensioning and holding under tension the cable or strap guided through the opening and a cap with a lock which can be positioned on the base plate so as to produce a seal around the tightening mechanism, characterised in that the securing means comprises a support extending on both sides of the cable or strap over a distance which is greater than the gap between the closed door and the frame, which distance is preferably greater than 5 mm.

BACKGROUND OF THE INVENTION

Closure means of this type are known, inter alia, from U.S. Pat. No. 5,369,970 and U.S. Pat. No. 5,582,046. In the case of these known means, the cable or strap is secured using a hook in the space located behind the door. It is necessary in this case for a fastening point behind which the hook can be secured to be provided in this space. It has been found that a fastening point of this type for a hook is not always provided and also cannot be attached without causing damage. There are also often no edges behind which the hook can be hooked, as is the case with small spaces behind the door. An example of this is a safe fitted in a hotel room or home. The known closure means is unsuitable for these small spaces.

SUMMARY OF THE INVENTION

In order to avoid this drawback, the closure means according to the invention is configured with a securing means comprising a support extending on both sides of the cable or strap over a distance which is greater than the gap between the closed door and the frame, which distance is preferably greater than 5 mm. As a result of the fact that the support extends on both sides of the cable or strap, it will also rest, on both sides of the cable or strap, on the door and/or the frame without the support having to be secured using a hook or the like. This allows the closure means to be used universally.

According to one embodiment, the closure means includes a support configured as a pin which is of such a length as to rest against frames positioned on both sides of the door, the length of the pin optionally being adjustable. This allows the support to be rested easily on the frame, wherein the pin can optionally be cut to length so that it can be used in doors of various dimensions.

According to one embodiment, the closure means includes a cable or a strap of tape having a width of at least 5 to 10 mm and the support extends perpendicularly to the tape on both sides of the tape. This ensures that the support is oriented at all times perpendicularly to the gap and will rest on the door and the frame and allows the cable or strap to be securely tightened.

According to one embodiment, the distance from the opening in the base plate to an edge of the base plate is at least 5 mm and preferably at least 10 mm. This prevents unauthorised persons from being able to cut through the cable or strap when the cable or strap is tightened.

According to one embodiment, the cable or strap comprises a woven plastics material strap with steel wire optionally woven into the strap. A strap of this type can easily be guided through the gap and fastened in the tightening mechanism.

According to one embodiment, the cable or strap is configured as a cord of steel wire or high-strength plastics material wire. Using cord allows the tightening means to be very compact in its configuration.

According to one embodiment, the cable or strap has a tensile strength of at least 3,000 N. This allows the tightening unit to be pulled with sufficient force against the door and/or the frame, so that the tightening means is difficult to move and the cable or strap cannot be cut through.

According to one embodiment, the tightening mechanism comprises a rotating shaft for winding up the cable or strap with a first catch which can block the rotation of the shaft and a lever with a second catch for rotating the shaft. This allows a high degree of tension easily to be applied to the cable or strap and the tightening unit to be pulled with a high degree of force against the door and/or the frame.

According to one embodiment, the tightening mechanism comprises a clamp for clamping the cable or strap and a screw with which the clamp can be pushed from the base plate. This allows the cable or strap to be tightened using an easily operable tightening means.

According to one embodiment, the clamp comprises a gap for feeding through the cable or strap between a movable clamping jaw and a stationary clamping jaw and also a spring for clamping the movable clamp to the cable or strap. This allows the cable or strap to be clamped at all times by spring force and prevents the clamp from becoming dislodged or shaking, as a result of which the closure means cannot be detached by unauthorised persons.

According to one embodiment, the tightening unit comprises warning means 85 which are activated, inter alia, if an unusual degree of force is exerted thereon. This prevents unnoticed opening of the closure means.

According to one embodiment, the support can be fastened to the frame or lateral edge using a magnet. This allows the support to be easily fastened before the cable or strap is tightened.

DETAILED DESCRIPTION OF THE INVENTION

Figure 1:
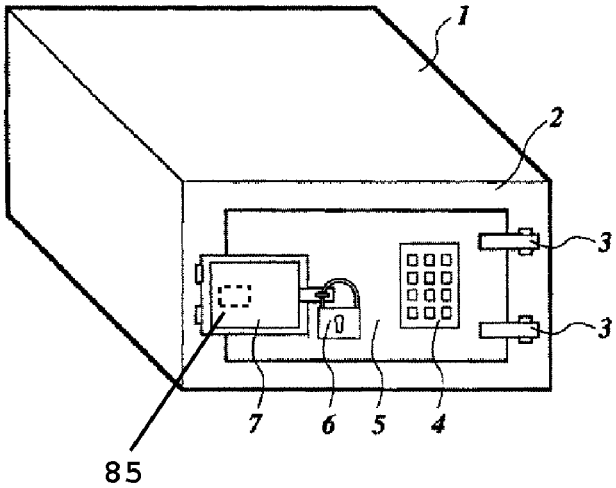
FIG. 1 is a perspective view of a safe with a door which is closed by a first embodiment of a closure means.

FIG. 1 is a perspective view of a safe 1, a safety lock 7 being used as an additional closure means. The safe 1 comprises a closable space with a frame 2. A door 5 is fastened to the frame 2 using hinges 3. The door 5 closes in the frame 2, a gap 8 remaining between the frame 2 and the door 5 (see FIG. 3). For closing the safe 1, the door 5 is provided with a lock 4 which is built into the door 5. With the lock 4, bolts 9 (see FIG. 2) are used for closing the safe 1. As additional protection, partly against unauthorised opening of the safe 1 by persons possessing a master code or master key to the lock 4, the safety lock 7 is provided on the door 5. The safety lock 7 has a padlock 6 which prevents access to the components of the safety lock 7, thus preventing the safety lock 7 from being removed and the safe 1 from being opened unnoticed and/or without traces of having been broken into, even if the lock 4 has already been opened.

Figure 2:
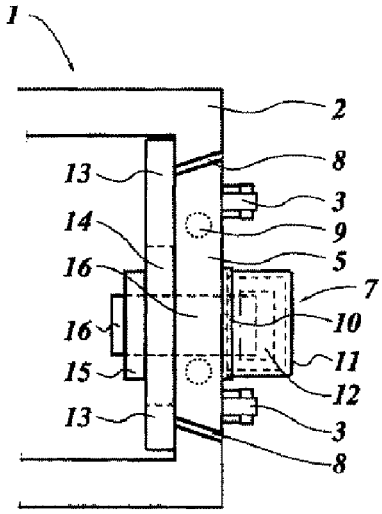
FIG. 2 is a side view of the safe with the closure means from FIG. 1.

FIG. 2 is a side view of the safe 1 and the door 5, the side wall of the safe 1 having been omitted for the sake of clarity. An anchor pin 13 is positioned on the inside of the door 5 in such a way that the two ends of the anchor pin 13 rest against the inside of the frame 2. The anchor pin 13 has a slot 14 through which a tightening strap 16 protrudes. The tightening strap 16 runs through the gap 8 from the inner edge of the safe 1 to the outer edge of the safe 1, the height of the passage through the gap 8 being chosen in such a way that the tightening strap 16 remains free from the bolts 9. For this purpose, the width of the slot 14 is such that the tightening strap 16 can be attached at various heights in the slot 14 in the anchor pin 13.

The end of the tightening strap 16 on the inside of the safe 1 is inserted through the slot 14 and fastened to an anchor plate 15, for example as a result of the fact that the tightening strap 16 runs in the shape of a loop 30 (see FIG. 3) through two openings 29 and is thus fastened to the anchor plate 15. Another way of fastening can be that the tightening strap 16 is inserted through a single opening in the anchor plate 15 where it is folded double and sewn to a blocking means which cannot be inserted through the opening in the anchor plate 15.

The anchor pin 13 is shown as a pin of fixed length. It will be clear that the anchor pin 13 has to be of such a length as to rest, at the upper edge and the lower edge, on the frames 2 of the door 5; the anchor pin 13 may be inclined for this purpose. In addition to the illustrated fixed length, it is possible to configure the anchor pin 13 in such a way that the length thereof may easily be adapted to the height of the safe 1, for example by providing screw-on parts on the anchor pin 13 or by pushing pieces of tubing onto the anchor pin 13 at the ends. Preferably, these pieces of tubing can be secured, thus allowing the anchor pin 13 to be adjusted in length and to be easily customised to the height of the door 5 and to be positioned at the inner edge of the door 5. The anchor pin 13 may be unscrewable, the anchor pin 13 being secured by being unscrewed through access between the walls, as a result of which said anchor pin is fixed between the walls. At its ends, the anchor pin 13 may be provided with hardened points which can come to be fixed in the walls.

The tightening strap 16 protrudes through the gap 8 toward the outer edge of the safe 1 and is pulled tight in the safety lock 7 once the door 5 has been closed, as a result of which the anchor pin 13 is secured on the inside of the safe 1 against the frame 2 and has a fixed position. At the same time, the safety lock 7 on the outside of the door 5 also has a fixed position.

The safety lock 7 consists of a base plate 10 with a cap 11 thereon. In the space formed by the base plate 10 and the cap 11 is a ratchet 12 which is suitable for tightening the tightening strap 16. The ratchet 12 is known to be of use, inter alia, in the tightening of tightening straps for the securing of loads to a vehicle and in many other applications in which something is secured using a tightening strap. In the known prior art, the tightening strap 16 is often fastened in a loop to the ratchet, for example to a fastening rod similar to fastening rod 31 of FIG. 3; the tightening strap 16 is subsequently wound around the objects to be bundled together and its free end 21 is inserted through a slot 25 in a tightening shaft 23 (see FIG. 3), after which the tightening shaft 23 is rotated and the tightening strap 16 tensioned. The tension in the tightening strap 16 causes said tightening strap to clamp around the tightening shaft 23. In the present application, the tightening strap 16 is not wound around an object to be bundled, although the tightening strap 16 is tensioned in a comparable manner once the free end 21 has been inserted through the slot 25 in the tightening shaft 23. The tightening of the tightening strap 16 on the ratchet 12 causes the tightening strap to be pulled tight between the ratchet 12 and the anchor plate 15, as a result of which the base plate 10 presses firmly against the door 5 and/or the frame 2, so that the door 5 can no longer be opened.

Figure 3:
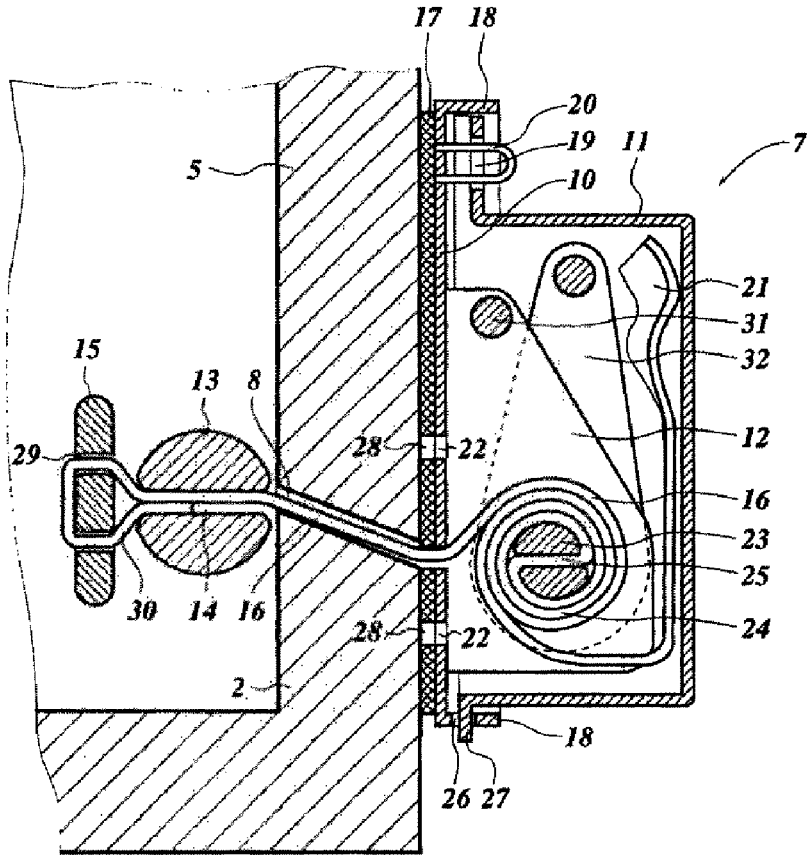
FIG. 3 is a section in plan view of the door and the closure means from FIG. 2.

FIG. 3 shows the safety lock 7 in greater detail. The ratchet 12 has a lever 32 with which the tightening shaft 23 can be rotated, so that the tightening strap 16 is wound around the tightening shaft 23. In order to hold the tightening strap 16 under tension and to prevent unwinding of the tightening strap 16, the tightening shaft 23 is provided with teeth (not shown) with which a first resilient catch (not shown) that is coupled to the base plate 10 engages. The lever 32 is provided with a second resilient catch which also engages with the teeth of the tightening shaft 23. When the second catch of the lever 32 engages with the teeth on the tightening shaft 23 and the lever is moved, a subsequent first catch invariably engages, thus winding up the tightening shaft 23. High forces are produced in the tightening strap 16 during winding-up of the tightening strap 16. For a ratchet 12 which is configured to allow a tightening strap having a width of 20 to 25 mm and a thickness of 1 mm to be wound around the tightening shaft 23, a force of 5,000 to 10,000 N may thus be applied with little difficulty in the tightening strap 16, so that this force presses the base plate 10 against the door 5 and the frame 2.

Attached below the base plate 10 is an intermediate plate 17 made, for example, of rubber which is able to yield under the influence of the force in the tightening strap 16. This intermediate plate 17 prevents damage to the door 5 and the frame 2. Applying a degree of resilience between the ratchet 12 and the door 5 on which the safety lock 7 rests facilitates tensioning of the tightening strap 16 with the ratchet 12 and hinders displacement of the safety lock 7 along the door 5. The ratchet 12 may be resiliently attached to the base plate 10.

A few openings 22 are formed next to one another in the base plate 10. The openings 22 have more or less the dimensions of the tightening strap 16, as a result of which said tightening strap is guided accurately toward the gap 8 and the edge of the bottom plate 10 is sufficiently wide around the opening 22. The distance from the opening 22 to the edge of the base plate 10 is preferably at least 10 mm; for further improved protection against cutting-through of the tightening strap 16, this distance is at least 15 mm. Corresponding openings 28 are formed in the intermediate plate 17. As a result of the edge around the openings 22 and 28, the tightening strap 16 is not accessible from the lateral edge of the base plate 10 when the tightening strap 16 pulls the base plate 10 against the door 5 and the frame 2 and cannot be cut through (otherwise, the cutting-through would be noted, thus establishing breaking-in). The fact that the tightening strap 16 cannot be detached unnoticed thus prevents the non-reusable closing device 7 from being detached from the door in any way other than by loosening the ratchet 12.

Formed in the base plate 10 and the intermediate plate 17, at a plurality of adjacent locations, are openings 22, 28 through which the base plate 10 can be placed in various positions relative to the gap 8 as a function of the situation and the dimensions of the safe 1.

The ratchet 12 is configured in such a way that detaching the first catch and the second catch from the teeth of the tightening shaft 23 allows said tightening shaft to rotate, so that the tensioning of the tightening strap 16 disappears, the tightening strap 16 can be unwound and the ratchet 12 can be detached from the tightening strap 16. A cap 11 is attached to the base plate 10 to prevent the ratchet 12 from being loosened by unauthorised persons. The base plate 10 has a reinforcing edge 18 all the way round. One or more openings 26 are formed in the reinforcing edge 18 and the hooks 27, which are attached to a side of the cap 11, are secured in these openings 26. On the other side of the openings 26, a shackle 20 is provided on the base plate 10. When the cap 11 is closed, the shackle 20 protrudes through an opening 19 in a projecting part of the cap 11. The padlock 6 is hooked by the shackle 20, thus preventing the cap 11 from being removed and denying unauthorised persons access to the ratchet 12.

In the illustrative embodiment shown in the present case, the cap 11 is provided with a padlock 6. In other embodiments, the coupling between the base plate 10 and cap 11 can be ensured differently using a lock 6, for example by integrating a lock into the cap 11. An alarm means and/or indicator, which advises the user that the cap 11 has been opened by unauthorised persons or that an attempt has been made to do so, can also be provided in the cap 11.

In the illustrative embodiment, the safety lock 7 is coupled to the anchor pin 13 by a tightening strap 16. The tightening strap 16 may be made of woven plastics material; steel wire may also be woven therethrough. Instead of a tightening strap 16, a cable may also be used. This cable may be made of woven steel wire or else of plastics material having high tensile strength. The ratchet 12 and the openings 22, 28 are then adapted accordingly.

For the application with the safe 1, the securing means is configured with the anchor pin 13. It will be clear that this securing means may, in this case and in other applications, also be configured differently. There will be situations in which merely an anchor plate 15 is sufficient; the dimensions thereof may be larger, so that the tensile force in the tightening strap 16 is distributed over a larger surface area. If there is merely the anchor plate 15, said anchor plate is, at each edge of the tightening strap 16, at least 10 mm in width, so that when the tightening strap 16 is tightened, one edge of the anchor plate 15 rests on the frame 2 and the other edge of the anchor plate 15 rests on the door 5. The securing means may also be provided with a rubber intermediate plate, comparable to the intermediate plate 17 in the base plate 10, in order to allow the forces to be effectively distributed and to prevent damage.

It will be clear that in the event of a high degree of tension in the tightening strap 16, a high degree of force is required to pull the door 5 into the frame 2. Usually, this means not that the door 5 rests against the frame 2 but rather that this high force is absorbed by the bolts 9 which are inserted into openings in the frame 2. As a result, these bolts 9 cannot be moved, or can hardly be moved, when the tightening strap 16 is tensioned. This also inhibits accidental opening of the door 5 during use of the safety lock 7.

Figure 4:
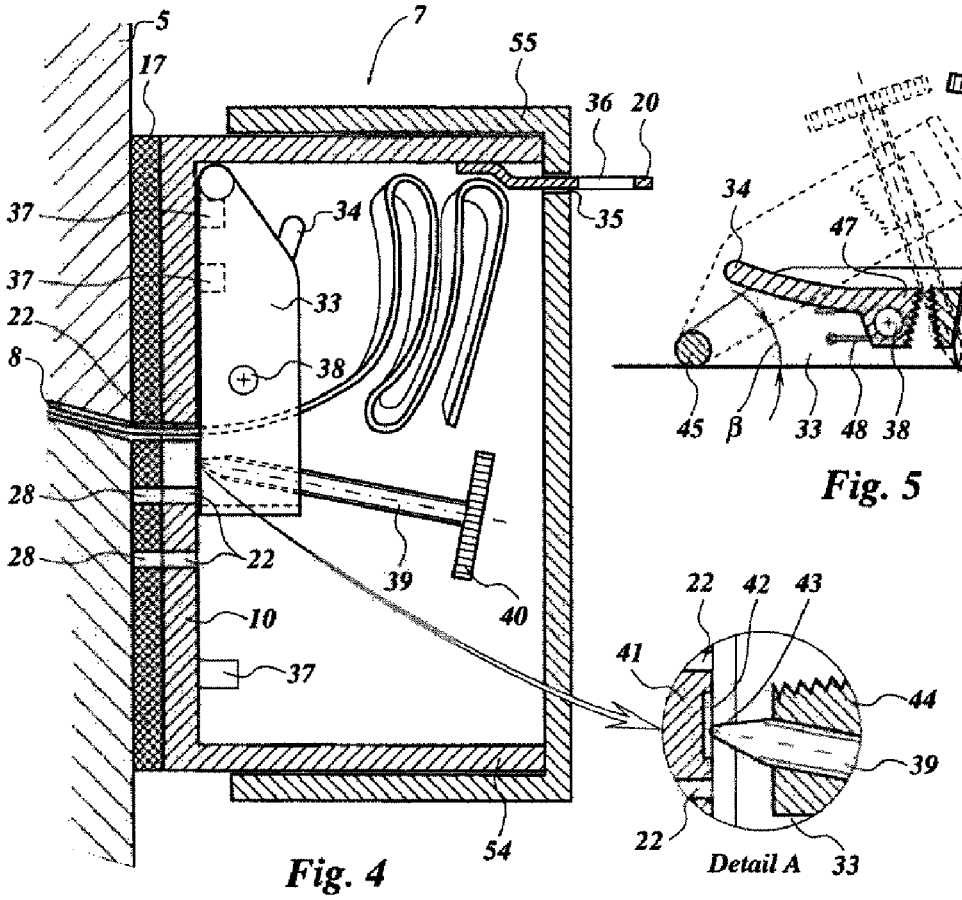
FIG. 4 is a schematic section of a second embodiment of the closure means.

FIG. 4 shows a second embodiment of the safety lock 7. The base plate 10 is provided with three openings 22 and the intermediate plate 17, which is fastened to the base plate 10, also has three openings 28. The intermediate plate 17 is made of rubber having a thickness of 2 to 5 mm, for example Para rubber, having a hardness of 40 to 45 Shore. The openings 22 have dimensions which tightly surround the tightening strap 16 and the size of the base plate 10 is such that the distance from the opening 22 to the edge of the base plate 10 is at least 5 to 7 mm and is preferably at least 10 mm.

The base plate 10 has a high edge 54 and a cap 55 surrounding the edge 54. The cap 55 contains an opening 35 through which the shackle 20 protrudes. Attaching the padlock 6 in a lock hole 36 prevents the cap 55 from being removed, so that the interior space within the high edge 54 is accessible only if removal of the cap 55 is not prevented by the padlock 6.

For tightening the tightening strap 16, a clamp 33 is positioned within the space surrounded by the high edge 54. The clamp 33 can be removed from the space within the high edge 54, for example for positioning the clamp 33 around the tightening strap 16, and can be placed in three positions on the base plate 10. For positioning the clamp 33, the base plate 10 has ridges 37.

Figure 5:
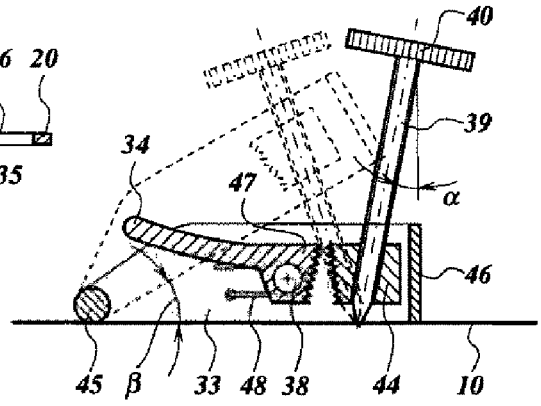
FIG. 5 is a schematic section of a clamp as used in the closure means from FIG. 4.

As shown in detail A of FIG. 4 and in FIG. 5, the clamp 33 has a stationary clamping jaw 44 and a movable clamping jaw 47. The movable clamping jaw 47 is able to rotate about an axis 38 and is rotated by a spring 48 in such a way that the opening between the clamping jaws 44, 47 becomes minimal and/or the clamping jaws are drawn together. The stationary clamping jaw 44 and the movable clamping jaw 47 are provided, at their mutually facing sides, with teeth, grooves or the like which can be pressed tight into the tightening strap 16 which can be clamped between the stationary clamping jaw 44 and the movable clamping jaw 47. The movable clamping jaw 47 is shaped in such a way that during rotation under the influence of the spring 48 the gap between the clamping jaws 44, 47 becomes smaller and during rotation in the opposite direction, for example if a lever 34 is pressed, the gap between the clamping jaws 44, 47 becomes larger. As a result of this construction, the tightening strap 16 becomes clamped between the clamping jaws 44, 47 if it is pulled from the side of the opening 22 and the tightening strap 16 can be moved only in the opposite direction and/or detached by pressing the lever 34.

For tightening the tightening strap 16, a screw 39 which can be screwed in manually by turning a wheel 40 is attached in the stationary clamping jaw 44. The end of the screw 39 is configured with a point 43 which has a small radius and wherein the point 43 is preferably hardened so as not to become deformed when loaded. The clamp 33, with a pin 45, is positioned by the ridges 37 in such a way that the point 43 rests on a back 41 between and next to the openings 22. The base plate 10 may be reinforced, below the point 43, with an optionally hardened plate 42, thus preventing deformation in the base plate 10 below the point 43 under the influence of the force in the tightening strap 16.

For tightening the tightening strap 16, the screw 39 is rotated, thus pressing the clamp 33 upward, said clamp being able to form a maximum angle of inclination β with the base plate 10. When the clamp 33 rests flat on the base plate 10, the screw 39 forms an angle α with the perpendicular on the surface of the base. The size of the angle α is approximately half the maximum angle of inclination β. In the example illustrated in the present case, β is at most approximately 20°, so α is approximately 10°. As a result of this and of the fact that the ridges 37 prevent the clamp 33 from moving, the point 43 remains more or less in the same position next to the opening(s) 22 and the point 43 cannot be clamped in a gap 22.

Figure 6:
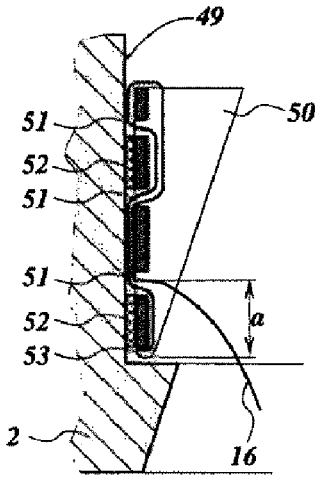
FIG. 6 is a schematic section of a securing means which is temporarily fastened to the side wall of the safe when the door is opened.
Figure 7:
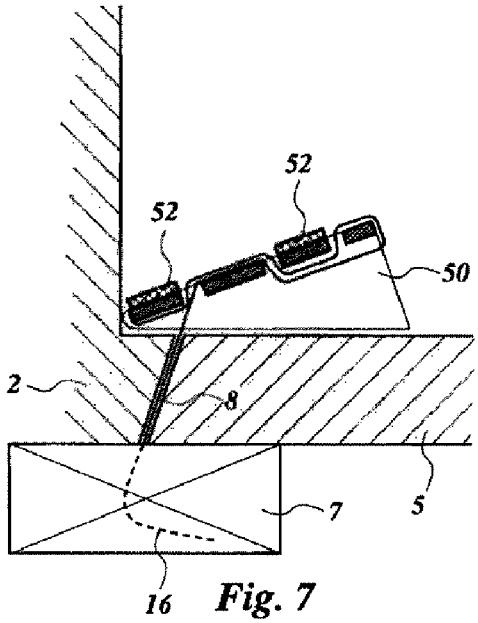
FIG. 7 is the section of FIG. 6, the door being closed.

FIGS. 6 and 7 show an anchor 50 allowing a securing means to be easily attached to the inside of the safe 1. The anchor 50 consists of a U-shaped profile member, of which the upright legs of the U become increasingly shorter and end in a rounding 53. Formed in the base of the U-shaped anchor 50 are three slots 51 by means of which the tightening strap 16 can be threaded and easily fastened to the anchor 50. Attached to the anchor 50 are two magnets 52 for temporarily fastening the anchor 50 to the frame 2 or lateral edge 49. The distance from the rounding 53 to the closest slot 51 is a distance a, a being approximately 10 to 15 mm.

The anchor 50 is used in such a way that the anchor 50 is secured, when the door 5 is opened, to an inner wall 49 of the safe 1 using the magnets 52. When the tightening strap 16 is pulled, once the door 5 has been closed, the anchor 50 will slide along the wall 49 until the rounding 53 strikes the frame 2. The anchor 50 will then be detached from the side wall 49 and tilt around the rounding 53 as a result of the distance a and become clamped before the gap 8 as a result of the fact that the anchor 50 rests at the same time on the frame 2 and the door 5. Owing to the oblique shape of the anchor 50, said anchor will also rest sufficiently against the door 5 if the door 5 falls back somewhat in relation to the frame 2.

The tightening strap 16 described hereinbefore is made of polyester and has a thickness of, for example, 0.8 mm. The tensile force can then be 3,000 N. If appropriate, the tightening strap 16 can be made of stronger material such as Kevlar.

Figure 8:
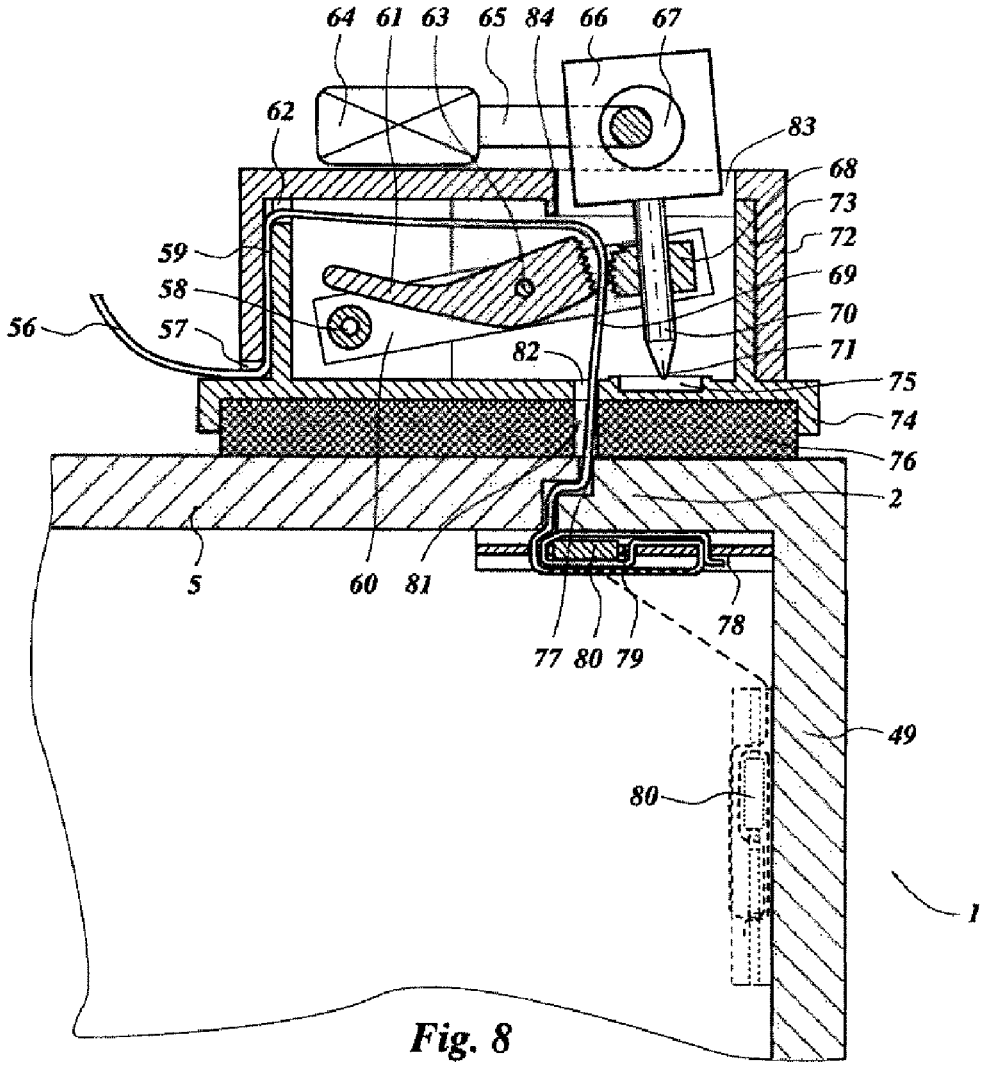
FIG. 8 is a schematic section of a third embodiment of the closure means.
Figure 9:
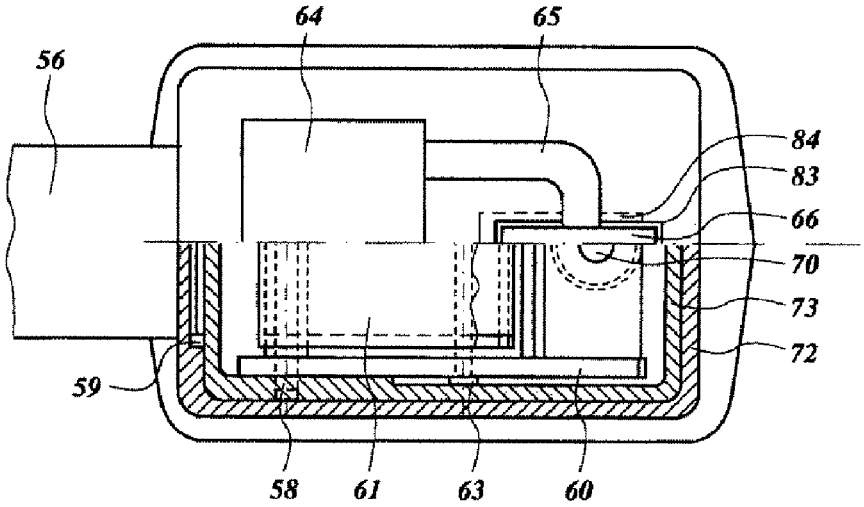
FIG. 9 is a plan view, partially in section, of the embodiment of the closure means according to FIG. 8.

FIGS. 8 and 9 show a third embodiment of the closure means according to the invention, this embodiment being in part identical to the embodiments described hereinbefore. A base part 73 has an edge 74 within which a flexible support plate 76 is attached. This flexible support plate 76 can be made of Para rubber and has, for example, a thickness of 8 mm and therefore protrudes by about 3 mm below the edge 74. As a result, the support plate 76 is unable to move relative to the base part 73 when said base part is clamped against the door 5 and/or the frame 2 of a safe 1. A clamp 60, which more or less corresponds to the clamp 33 shown in FIG. 4, is fastened in the base part 73 by a pin 58. The clamp 60 is able to rotate about the pin 58. As described previously, the clamp 60 has a rotatable clamping jaw 61 which is able to rotate about an axis of rotation 63 and which is pressed against a fixed clamping jaw 68 by a spring (not shown in the present case). In the illustrated situation, a tightened tightening strap 69 is clamped between the rotatable clamping jaw 61 and the fixed clamping jaw 68, thus drawing an anchor plate 78 toward the inside of the door 5 and the frame 2. For feeding-through of the tightened tightening strap 69, the base part 73 has an opening 82 and the flexible support plate 76 an opening 81. The distance between the edge 74 and the openings 81, 82 is greater than 5 mm and preferably greater than 10 mm.

The tightening strap 69 is tightened by turning a screw 70 in the clamp 60, as a result of which the clamp 60, resting on the base part 73, is pressed away from the base part 73. The screw 70 rests with a point 71 on the base part 73, optionally on a plate 75 which is fastened for the purposes of reinforcement in the base of the base part 73, and is fastened with a screw thread in the clamp 60 and, in particular, in the fixed clamping jaw 68. Turning the screw 70 out of the clamp 60 on the underside causes the clamp 60 to rotate about the pin 58 and to tighten the tightening strap 69. In order to be able to turn the screw 70, said screw has a grip 66.

A cap 72 is placed over the base part 73 to prevent the clamp 60 from being detached by unauthorised persons. The cap 72 has an opening 83 which closes around the grip 66 with a small gap. The portion of the grip 66 that protrudes above the cap 72 has an opening 67. A lock shackle 65 of a lock 64 can be hooked through the opening 67, thus preventing the cap 72 from being removed. The gap between the cap 72 and the grip 66 is very narrow, thus preventing the clamp 60 from becoming detached by the insertion of objects through the gap. An edge 84 may also be provided for this purpose on the inside of the cap 72.

In order to be able to lead a free end 56 of the tightening strap toward the outside of the closure means, the base part 73 has a recess 62 on the upper side and the cap 72 has a recess 59 on the inside of a lateral edge and a recess 57 on the underside. The recesses 57, 59, 62 are formed in such a way that the free end 56 of the tightening strap is led through two angles which are more or less right angles. As a result, it is not possible to tighten the tightening strap led through the recesses by pulling on the free end 56. This means that the tightening strap cannot be tightened when the cap 72 is placed on the base part 73. Unauthorised opening of the safe 1 can therefore not be masked by subsequently tightening the tightening strap.

The anchor plate 78 is provided with a magnet 80 with which it can temporarily be fastened to the frame 2 or the lateral edge 49 for closing the door 5 (this position is shown in FIG. 8 by broken lines). The anchor plate 78 has three openings 79 through which the tightening strap is threaded so as to be secured in the anchor plate 78. The distance from the openings 79 to the end of the anchor plate 78 is such that the anchor plate 78 can never be pulled through the gap 77; in most situations, a minimum distance of 10 mm can be adhered to for this purpose, so that the anchor plate 78 protrudes by at least this distance on both sides of the tightening strap.

The invention has been described above with reference to a few illustrative embodiments for ensuring the closure of a safe door, the use of the closure means preventing the door from being able to be opened without showing signs of having been broken into. It will be clear to a person skilled in the art that there are other situations in which breaking-in cannot always be prevented but in which it is important to the owner that damage is perceivable in the event of breaking-in. Examples include doors of a cabin of a motor or sailing yacht in a harbour, country cottages or other locations which are not regularly monitored. The closure means according to the invention can easily be used in these situations too, wherein the securing means can in all cases be adapted to the situation and wherein, in the event of breaking-in, either the lock to the closure means or the tightening strap will be damaged.

What is claimed is:

1. A closure for holding closed a door in a frame, comprising:

a securing device positioned on a first side of the closed door, a tightening unit positioned on a second side of the closed door and a cable, when the door is closed, runs through a gap between the door and the frame, which cable is fastened at one end to the securing device and at the other end in the tightening unit, the tightening unit comprising a base plate with an opening for feeding through the cable connected to the securing device, a tightening mechanism for tensioning and holding under tension the cable guided through the opening and a cap with a lock, the cap and the base plate forming an enclosure around the tightening mechanism, characterised in that the securing device comprises a support extending on both sides of the cable with a smallest dimension that is greater than the gap between the closed door and the frame, and in that the tightening mechanism comprises a clamp with teeth for gripping the cable at any length.

2. The closure according to claim 1, wherein the support is configured as a pin with a length longer than the width of the door.

3. The closure according to claim 1, wherein the cable is a tape having a width of at least 5 to 10 mm and the support extends perpendicularly to the tape on both sides of the tape.

4. The closure according to claim 1, wherein a distance from the opening in the base plate to an edge of the base plate is at least 5 mm.

5. The closure according to claim 1, wherein the cable comprises one of at least a woven plastics material and a woven plastics material with steel wire woven into the cable.

6. The closure according to claim 1, wherein the cable is configured as one of at least a wire of steel and a high-strength plastics material.

7. The closure according to claim 1, wherein the cable has a tensile strength of at least 3,000 N.

8. The closure according to claim 1, wherein the clamp comprises an opening for feeding through the cable between a movable clamping jaw and a stationary clamping jaw and also a spring for rotating the movable clamping jaw so that the opening becomes minimal.

9. The closure according to claim 1, wherein the tightening unit comprises a warning which is activated if an unusual degree of force is exerted on the closure.

10. The closure according claim 1, wherein the support includes a magnet that can be fastened to the frame.

11. The closure according to claim 1, wherein a screw can rotate in the clamp to tension the cable and the closed enclosure prevents rotation of the screw.

12. The closure according to claim 11, wherein the screw comprises a head with an eye opening, and the cap comprises a slot through which the head extends when the cap forms an enclosure around the clamp and wherein the slot prevents rotation of the head and the lock through the eye opening prevents removal of the cap.

13. A closure device for holding closed a door in a frame, comprising:

a securing device adapted to be positioned on one side of the closed door;

a tightening unit adapted to be positioned on another side of the closed door;

a cable adapted to run through a gap between the door and the frame, said cable being fastened at a first end to said securing device and at a second end to said tightening unit;

wherein said tightening unit comprises:

a base plate with an opening for feeding through said cable connected to said securing device, a cap with a lock, and a tightening mechanism for tensioning and holding said cable guided through said opening, said cap and said base plate forming an enclosure around said tightening mechanism;

wherein said securing device has a support extending on both sides of the cable with a smallest dimension adapted to be greater than the gap between the closed door and the frame; and wherein said tightening mechanism comprises a clamp with teeth for gripping said cable at any length.

14. The closure according to claim 13, wherein the support is configured as a pin with a length longer than the width of the door.

15. The closure device according to claim 13, wherein the cable is a tape having a width of at least 5 to 10 mm and the support extends perpendicularly to the tape on both sides of the tape.

16. The closure device according to claim 13, wherein a distance from the opening in the base plate to an edge of the base plate is at least 5 mm.

17. The closure device according to claim 13, wherein the cablc compriscs cable comprises one of at least a woven plastics material and a woven plastics material with steel wire woven into the cable.

18. The closure device according to claim 13, wherein the cable is configured as one of at least a wire of steel and a high-strength plastics material.

19. The closure device according to claim 13, wherein the cable has a tensile strength of at least 3,000 N.

20. The closure device according to claim 13, wherein the clamp comprises an opening for feeding through the cable between a movable clamping jaw and a stationary clamping jaw and also a spring for rotating the movable clamping jaw so that the opening becomes minimal.

* * * * *